US008490965B2

(12) United States Patent
Ueda et al.

(10) Patent No.: US 8,490,965 B2
(45) Date of Patent: Jul. 23, 2013

(54) SHEET-SUPPLYING DEVICE

(75) Inventors: Satoshi Ueda, Hitachinaka (JP); Shingo Takai, Hitachinaka (JP); Tatsuo Matsuda, Hitachinaka (JP); Kazuhiko Kawasaki, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 15 days.

(21) Appl. No.: 12/720,111

(22) Filed: Mar. 9, 2010

(65) Prior Publication Data

US 2010/0164165 A1 Jul. 1, 2010

Related U.S. Application Data

(63) Continuation of application No. 12/262,386, filed on Oct. 31, 2008, now Pat. No. 7,841,591, which is a continuation of application No. 11/223,697, filed on Sep. 12, 2005, now Pat. No. 7,458,570.

(30) Foreign Application Priority Data

Sep. 13, 2004 (JP) ..... P2004-265317
Jul. 15, 2005 (JP) ..... P2005-207054

(51) Int. Cl.
*B65H 3/14* (2006.01)

(52) U.S. Cl.
USPC ..... 271/98; 271/97; 271/152

(58) Field of Classification Search
USPC ..... 271/96, 97, 98, 152
See application file for complete search history.

(56) References Cited

U.S. PATENT DOCUMENTS

| | | | | |
|---|---|---|---|---|
| 5,092,578 | A * | 3/1992 | Bergmeier et al. | 271/97 |
| 5,645,274 | A * | 7/1997 | Ubayashi et al. | 271/94 |
| 5,709,379 | A * | 1/1998 | Lotsch et al. | 271/105 |
| 6,279,896 | B1 | 8/2001 | Linder et al. | |
| 6,354,585 | B1 | 3/2002 | Takahashi | |
| 6,412,769 | B1 * | 7/2002 | Goda et al. | 271/94 |
| 6,543,759 | B2 * | 4/2003 | Yamaguchi et al. | 271/98 |
| 6,698,747 | B2 * | 3/2004 | Dobbertin et al. | 271/30.1 |
| 6,955,348 | B2 * | 10/2005 | Koga | 271/97 |
| 7,237,771 | B2 * | 7/2007 | Lang et al. | 271/9.01 |
| 7,419,152 | B2 * | 9/2008 | Adachi | 271/97 |
| 7,537,208 | B2 * | 5/2009 | Fukusaka et al. | 271/96 |
| 7,575,231 | B2 * | 8/2009 | Sasaki et al. | 271/98 |

(Continued)

FOREIGN PATENT DOCUMENTS

| | | |
|---|---|---|
| DE | 295 03 618 | 2/1995 |
| DE | 195 26 595 | 6/1995 |

(Continued)

*Primary Examiner* — Kaitlin Joerger
(74) *Attorney, Agent, or Firm* — Whitham Curtis Christofferson & Cook, PC

(57) ABSTRACT

A sheet-supplying device has a sheet-accommodating tray, a raising/lowering unit, a first position sensor, a second position sensor, a controlling unit. The raising/lowering unit raises and lowers the sheet-accommodating tray substantially. The first position sensor detects a first position indicating a position in the stacked direction of one end portion of a topmost sheet stacked in the sheet-accommodating tray. The second position sensor detects a second position indicating a position in the stacked direction of another end portion of the topmost sheet. The controlling unit controls the raising/lowering unit to raise or lower the sheet-accommodating tray based on both the first position detected by the first position sensor and the second position detected by the second position sensor so that one end of the topmost sheet in the stacked status is positioned at a prescribed position in the stacked direction.

14 Claims, 8 Drawing Sheets

U.S. PATENT DOCUMENTS

| | | | | |
|---|---|---|---|---|
| 7,588,244 | B2 * | 9/2009 | Kawamoto et al. | 271/31 |
| 5,090,676 | A1 | 6/2012 | Matsuno | |
| 2001/0017441 | A1 | 8/2001 | Yamaguchi et al. | |
| 2002/0145246 | A1 * | 10/2002 | Goda et al. | 271/98 |
| 2004/0089994 | A1 * | 5/2004 | Koga et al. | 271/98 |
| 2004/0178557 | A1 * | 9/2004 | Okazaki et al. | 271/97 |
| 2005/0206068 | A1 * | 9/2005 | Sasaki et al. | 271/98 |
| 2006/0175746 | A1 * | 8/2006 | Adachi | 271/97 |
| 2009/0267288 | A1 | 10/2009 | Sasaki | |

FOREIGN PATENT DOCUMENTS

| | | |
|---|---|---|
| DE | 197 14 204 | 7/1997 |
| DE | 100 57 052 | 11/2000 |
| DE | 202 03 617 | 6/2002 |
| JP | 7-89625 | 4/1995 |
| JP | 7-187422 | 7/1995 |
| JP | 07-187422 | 7/1995 |
| JP | 10-095543 | 4/1998 |
| JP | 11-322101 | 11/1999 |
| JP | 2000344358 | 12/2000 |
| JP | 2003-95467 | 4/2003 |
| JP | 2005272019 | 10/2005 |
| JP | 20055272019 | 10/2005 |
| JP | 2006-143399 | 6/2006 |

* cited by examiner

SHEET-SUPPLYING DEVICE

CROSS REFERENCE TO RELATED APPLICATIONS

This application is a continuation of application Ser. No. 12/262,386 filed Oct. 31, 2008, now U.S. Pat. No. 7,841,591, which in turn was a continuation of application Ser. No. 11/223,697 filed Sep. 12, 2005, now U.S. Pat. No. 7,458,570.

BACKGROUND OF THE INVENTION

1. Field of the Invention

The present invention relates to a sheet-supplying device employed in an image-forming device.

2. Description of the Related Art

Sheet-supplying devices using air suction are well known in the art as sheet-supplying devices used in printers, photocopiers, and other image-forming devices. FIG. 1 illustrates the function of a sheet-supplying device 101 of this type. As shown in FIG. 1, the sheet-supplying device 101 includes a sheet-accommodating tray 111 and a sheet-feeding device 112 disposed above the sheet-accommodating tray 111. The sheet-feeding device 112 includes a sheet-feeding belt 112C and an air suction device 113. A plurality of sheets 102 is stacked on top of the sheet-accommodating tray 111. The sheet 102 positioned on the top of the stack is referred to as a topmost sheet 102A. When the air suction device 113 draws the topmost sheet 102A up to the sheet-feeding belt 112C, the sheet-feeding belt 112C conveys the topmost sheet 102A to a prescribed position.

An air-jetting device 114 is disposed on the front side of the sheet-accommodating tray 111, that is, on the left side in FIG. 1. The air-jetting device 114 blows a jet of air onto one end of the sheets 102, causing a few sheets 102 stacked on the sheet-accommodating tray 111 to float and separate. A position sensor 116 is disposed on the other end of the sheets 102, which end is unaffected by the air blown from the air-jetting device 114 and does not float. The position sensor 116 includes a digital sensor 116A and a surface position-detecting lever 116B. A raising/lowering device (not shown) is connected to the sheet-accommodating tray 111 and is capable of raising and lowering the same. The raising/lowering device raises the sheet-accommodating tray 111 until the topmost sheet 102A contacts the surface position-detecting lever 116B. At this time, the surface position-detecting lever 116B is displaced vertically upward, enabling the position sensor 116 to detect the position of other end of the topmost sheet 102A based on the position of the surface position-detecting lever 116B.

A plurality of suction holes (not shown) is formed over the entire surface of the sheet-feeding belt 112C. By means of these suction holes and the air suction device 113, sheets can be drawn to and conveyed by the sheet-feeding belt 112C.

Next, steps in a control process of the controlling device (not shown) for controlling operations of this conventional sheet-supplying device will be described with reference to the flowchart in FIG. 2. A controller (not shown) monitors whether the position sensor 116 has detected that the topmost sheet 102A has contacted the surface position-detecting lever 1163 (S101). If the position sensor 116 has not detected this contact (S101: NO), the controller raises the sheet-accommodating tray 111 (S102), and then the controller monitors again whether the position sensor 116 has detected this contact (S101). When the position sensor 116 detects that the topmost sheet 102A has contacted the surface position-detecting lever 116B (S101: YES), then the controller judges whether the sheet-accommodating tray 111 has stopped (S103).

When the sheet-accommodating tray 111 has not stopped (S103: NO), the controller stops the raising of the sheet-accommodating tray 111 (S104). Then, the controller controls the air-jetting device 114 to blow air onto the one end of the sheets 102 stacked on the sheet-accommodating tray 111 and the air suction device 113 to draw air (S105).

The air blown from the air-jetting device 114 floats and separates a few of the top sheets 102. The topmost sheet 102A that is among the separated sheets 102 is drawn to the sheet-feeding belt 112C by the air suction device 113. The topmost sheet 102A that has been drawn to the sheet-feeding belt 112C is conveyed to a prescribed position by the rotation of the sheet-feeding belt 112C. When the topmost sheet 102A has been conveyed in this way, the controller repeats S101-S105 with respect to the following topmost sheet 102A.

By the way, when the number of sheets 102 stacked on the sheet-accommodating tray 111 decreases and the vertical position of the topmost sheet 102A becomes lower. Then, the topmost sheet 102A cannot be detected by the position sensor 116 (S101: NO). In such a case, the controller raises the sheet-accommodating tray 111 (S102). On the other hand, when the number of sheets 102 has not likely decreased by much and the vertical position of the topmost sheet 102A has not dropped that much, the topmost sheet 102A is detected soon by the position sensor 116 (S101: YES).

Japanese unexamined patent application publication No. HEI-7-187422 discloses a sheet-supplying device that can adjust the position and angle of the jetted air based on the vertical position of the topmost sheet. Accordingly, this sheet-supplying device can separate floating sheets from one another, even when the sheets have a tendency to curl.

Japanese unexamined patent application publication No. HEI-7-89625 discloses a sheet-supplying device 201 as shown in FIG. 3 that includes an air-jetting device 214 for blowing a jet of air, and a reflecting type distance-measuring sensor 215 for measuring part of a topmost sheet 202A that is floated by air blown from the air-jetting device 214. With this construction, the sheet-supplying device 201 can adjust the amount of jetted air from the air-jetting device 214 based on the vertical position of the topmost sheet 202A measured by the reflecting type distance-measuring sensor 215.

However, when there is a curl in the sheets, the vertical position of the topmost sheet differs between its front end and rear end, that is, between the left and right ends in FIG. 1. Since the conventional sheet-supplying devices as shown in FIG. 1 use a position sensor to detect only the position of the sheet at the rear end thereof, the front end of the topmost sheet may not be in an optimal position for being drawn to and conveyed by the sheet-feeding device, even if the vertical position of the topmost sheet at the rear end thereof is in the optimal position. This may result in such problems as a plurality of sheets being fed simultaneously in the sheet-feeding operation or the feeding belt being unable to draw the topmost sheet by air suction and therefore failing to feed the sheet.

Further, although the sheet-supplying device disclosed in Japanese unexamined patent application publication No. HEI-7-187422 can adjust the position and angle of the jetted air based on the vertical position of the topmost sheet, this construction is complex and increases the manufacturing costs of the device. Further, since the optimal vertical position of the topmost sheet for pickup by air suction differs based on the sheet weight and quality, feeding failures and the feeding of multiple sheets simultaneously may occur when different types of sheets are used.

The sheet-supplying device disclosed in Japanese unexamined patent application publication No. HEI-7-89625 uses a reflective type distance-measuring sensor to measure the vertical position of the topmost sheet on the end of the sheet that is floating and fluttering by the jetted air. Such measurements are unreliable and do not produce accurate values. Therefore, this device cannot reliably output an optimal volume of air.

SUMMARY OF THE INVENTION

In view of the foregoing, it is an object of the present invention to provide a sheet-supplying device having a suction-device that can pick up only the topmost sheet and reliably feed the sheets without skipping sheets or feeding multiple sheets simultaneously.

In order to attain the above and other objects, the present invention provides a sheet-supplying device including a sheet-accommodating tray, a raising/lowering unit, a first position sensor, a second position sensor, a controlling unit, an air jetting unit, a sucking unit sucking air and a sheet-conveying unit.

The sheet-accommodating tray has a bottom plate for supporting a plurality of sheets in a stacked arrangement, wherein the sheet has a surface including one end portion and another end portion. The raising/lowering unit raises and lowers the sheet-accommodating tray in a stacked direction substantially perpendicular to the bottom plate. The first position sensor detects a first position indicating a position in the stacked direction of one end portion of a topmost sheet stacked in the sheet-accommodating tray. The second position sensor detects a second position indicating a position in the stacked direction of another end portion of the topmost sheet.

The controlling unit controls the raising/lowering unit to raise or lower the sheet-accommodating tray based on both the first position detected by the first position sensor and the second position detected by the second position sensor so that one end of the topmost sheet in the stacked status is positioned at a prescribed position in the stacked direction.

The air jetting unit blows air onto one end portion of the topmost sheet in order to float one end portion of the topmost sheet. The sucking unit sucks air in order to attract the sheet, wherein only the topmost sheet in the floated status is attracted when one end of the topmost sheet in the stacked status is at the prescribed position. The sheet-conveying unit conveys the sheet attracted to the sucking unit.

Another aspect of the present invention provides a controlling method for conveying a plurality of sheets stacked at a bottom plate of a sheet-accommodating tray in a stacked direction perpendicular to the bottom plate. The sheet has a surface including one end portion and another end portion.

The controlling method includes steps (a)-(f). The step (a) detects a first position indicating a position in the stacked direction of one end portion of a topmost sheet stacked in the sheet-accommodating tray and a second position indicating a position in the stacked direction of another end portion of the topmost sheet. The step (b) raises or lowers the sheet-accommodating tray so that one end of the topmost sheet in the stacked status is positioned at a prescribed position in the stacked direction. The step (c) determines, as the prescribed position, the second position detected when the first position has reached to the prescribed position. The step (d) blows air onto one end portion of the topmost sheet in order to float one end portion of the topmost sheet, after the step of (c). The step (e) sucks air in order to attract the sheet, wherein only the topmost sheet in the floated status is attracted when one end of the topmost sheet in the stacked status is at the prescribed position. The step (f) conveys the attracted sheet.

BRIEF DESCRIPTION OF THE DRAWINGS

The above and other objects, features, and advantages of the invention will become more apparent from reading the following description of the preferred embodiments taken in connection with the accompanying drawings in which.

DESCRIPTION OF THE PREFERRED EMBODIMENTS

A sheet-supplying device according to a first embodiment of the present invention will be described with reference to FIGS. 4 through 8.

Figure 4:
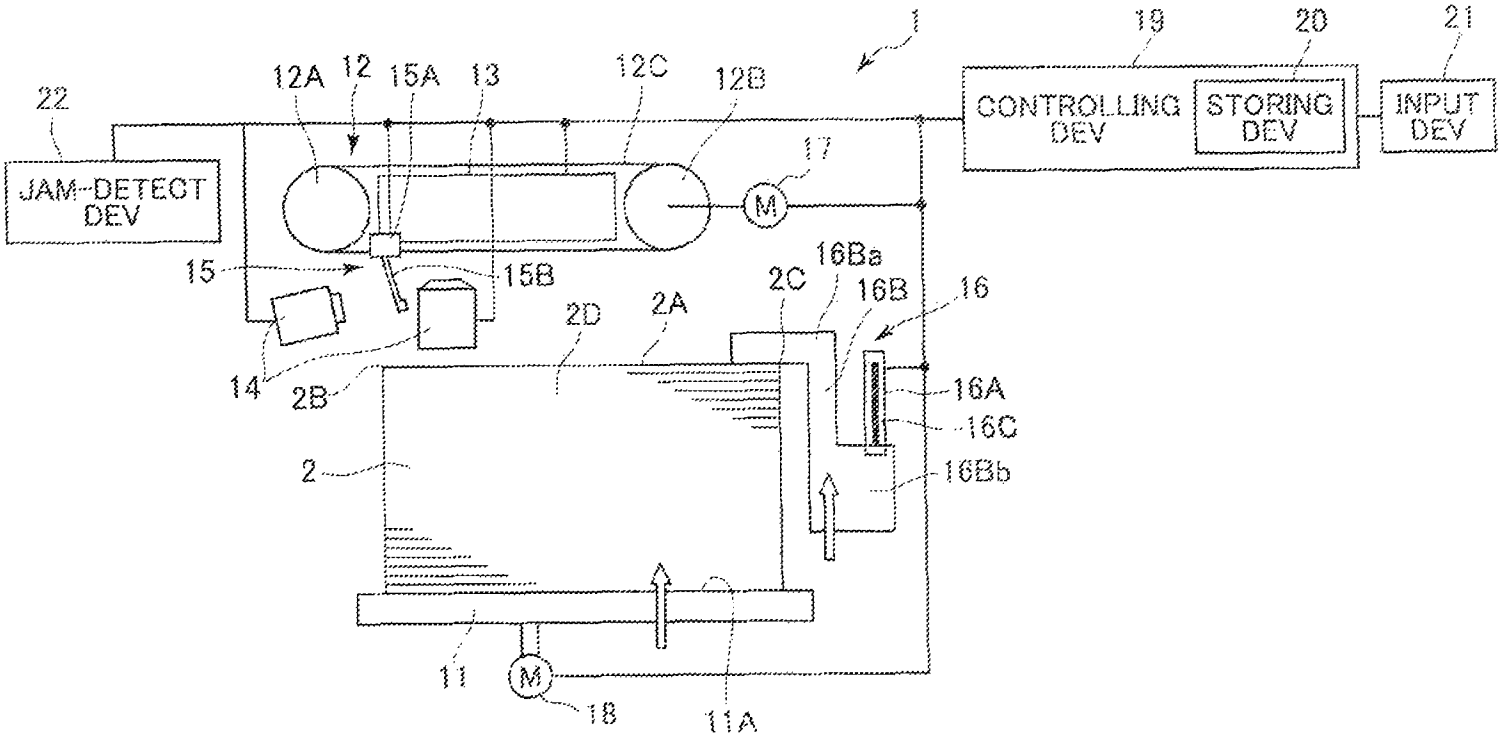
FIG. 4 is a side view showing a sheet-supplying device according to a first embodiment of the present invention.

As shown in FIG. 4, a sheet-supplying device 1 includes a sheet-accommodating tray 11, a sheet-feeding device 12, a suction device 13, air-jetting devices 14, a reference position sensor 15, an analog position sensor 16, a driving device 17, a raising/lowering device 18, a controlling device 19, an input device 21, and a paper-jam-detecting device 22. The suction device 13, air-jetting devices 14, reference position sensor 15, analog position sensor 16, driving device 17, raising/lowering device 18, input device 21, and paper-jam-detecting device 22 are all connected to the controlling device 19. The controlling device 19 includes a storing device 20. The sheet-accommodating tray 11 is coupled with the raising/lowering device 18. The sheet-feeding device 12 is coupled with the driving device 17.

The sheet-accommodating tray 11 has a surface 11A that is substantially flat. A plurality of sheets 2 is stacked on the surface 11A. The controlling device 19 connected to the raising/lowering device 18 controls the raising/lowering device 18 to raise and lower the sheet-accommodating tray 11. The sheet-feeding device 12 is configured of two rollers 12A and 12B, and a sheet-feeding belt 12C that is looped around the rollers 12A and 12B. The roller 12B is coupled with the driving device 17 and is driven to rotate by the same. When the roller 128 rotates, the roller 12A and sheet-feeding belt 12C follow the rotation of the roller 128.

The controlling device 19 connected to the driving device 17 controls the driving of the driving device 17 so as to control the rotation of the sheet-feeding belt 12C. By rotating, the sheet-feeding belt 12C conveys the sheet 2 to a position downstream at which a sheet-conveyed device (not shown) and a paper-jam-detecting device 22 are provided. Here, the sheet-conveyed device may be a photosensitive drum or the like provided inside a printer or the like to which the sheet 2 is conveyed.

Figure 6:
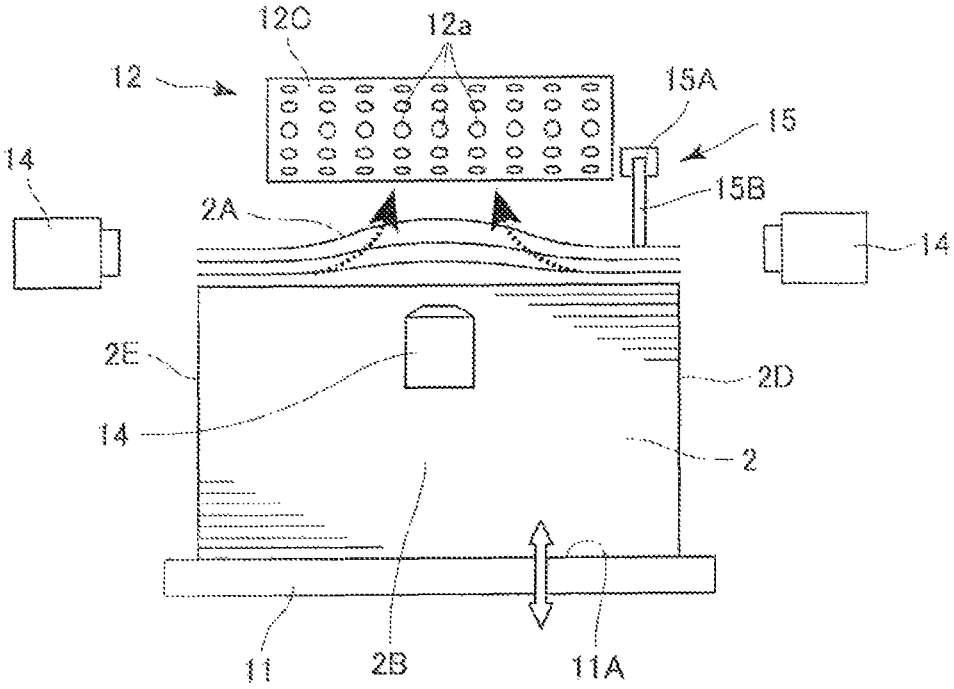
FIG. 6 is a front view of the sheet-supplying device according to the first embodiment in which the topmost sheet is drawn toward the feeding belt.
Figure 7:
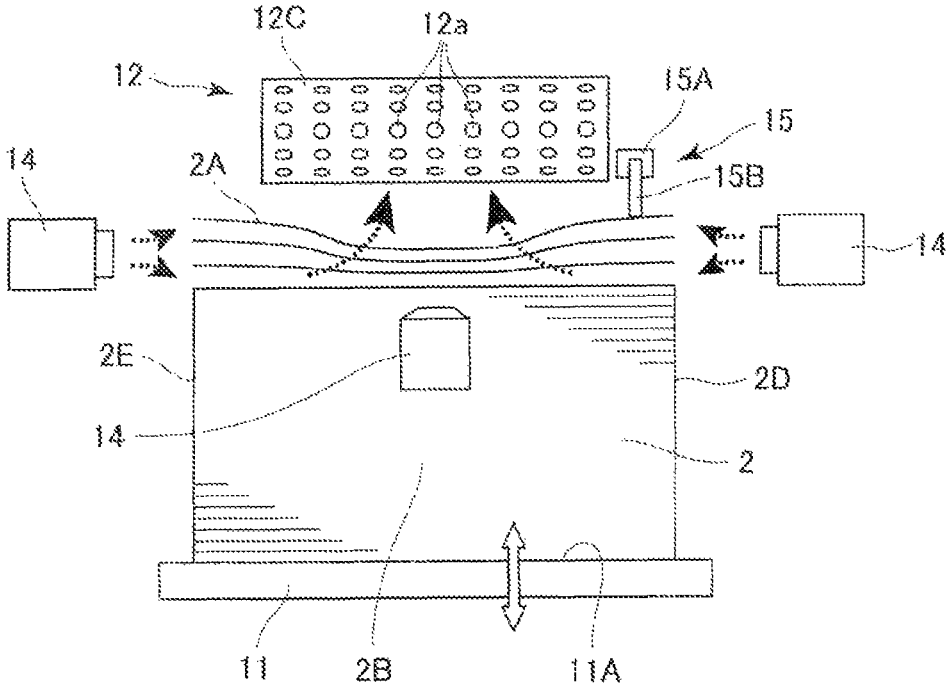
FIG. 7 is a front view of the sheet-supplying device according to the first embodiment in which the topmost sheet is drawn toward the feeding belt.

As shown in FIGS. 6 and 7, a plurality of suction holes 12*a* is formed across the entire surface of the sheet-feeding belt 12C. The suction device 13 (FIG. 4) is provided in a space formed inside the sheet-feeding belt 12C for drawing air in through the suction holes 12*a*.

The controlling device 19 controls the air suction of the suction device 13. By drawing air in through the suction holes 12*a*, the suction device 13 can draw a sheet positioned on top of the plurality of sheets 2 stacked on the sheet-accommodating tray 11 (hereinafter referred to as the "topmost sheet 2A") to the sheet-feeding belt 12C one sheet at a time.

The sheets 2 have a substantially rectangular shape defined by a pair of sides including a first side 2B and a second side 2C, and a pair of sides including a third side 2D and a fourth side 2E (see FIG. 6). The first side 2B of the sheet 2 is positioned on the left side in FIG. 4, while the second side 2C of the sheet 2 is positioned on the right side in FIG. 4. The third side 2D and fourth side 23 of the sheet 2 run in a direction connecting the two rollers 12A and 12B of the sheet-feeding device 12. The third side 20 of the sheet 2 is the portion shown in the foreground of FIG. 4, while the fourth side 2E of the sheet 2 (FIG. 6) is positioned in the background and is not shown in FIG. 4.

As shown in FIGS. 6 and 7, the air-jetting devices 14 are disposed at a total of three positions near the topmost sheet 2A: a first position facing the first side 2B, a second position facing the third side 2D, and a third position facing the fourth side 2E. By ejecting air near the end of the topmost sheet 2A, the air-jetting devices 14 can float the end of the topmost sheet 2A and the end of sheets 2 stacked just below the topmost sheet 2A so that these sheets 2 are separated from each other at the same end.

While the directions of the jetted air are fixed, the jetted air can be switched on and off independently among the air-jetting devices 14 at each of the three positions. For example, it is possible to eject air from only the air-jetting device 14 at the first position, as shown in FIG. 6, or to eject air from only the air-jetting devices 14 at the second and third positions, as shown in FIG. 7. The controlling device 19 controls the air-jetting devices 14 based on weight of the sheet 2 described later.

The reference position sensor 15 includes a digital sensor 15A, such as a photo-sensor with an actuator or the like, and a detecting lever 15B. As shown in FIG. 4, the reference position sensor 15 is disposed at a position above the first side 28 of the topmost sheet 2A. The detecting lever 15B can rotate about the digital sensor 15A. When the detecting lever 15B rotates, the detector plane of the digital sensor 15A is exposed. In the preferred embodiment, the sheet-accommodating tray 11 is raised until the topmost sheet 2A contacts the detecting lever 15B and the detector plane of the digital sensor 15A is exposed entirely. At this time, the controlling device 19 determines that the first side 2B of the topmost sheet 2A is in a vertical position that is optimal for the suction device 13 to pick up the topmost sheet 2A (hereinafter referred to as an "optimal vertical position").

The analog position sensor 16 includes an analog sensing part 16A configured of a reflecting or transmitting CCD or linear sensor, an analog sensor with an analog voltage output, or the like; and a surface position-detecting lever 16B having an upper end 16Ba and a lower end 16Bb. The upper end 16Ba is bent approximately in an L-shape and is in constant contact with the second side 2C of the topmost sheet 2A. The surface position-detecting lever 16B is capable of moving vertically and moves downward when the number of sheets 2 stacked on the sheet-accommodating tray 11 decreases.

The lower end l6Bb is also bent in an approximate L-shape and is positioned near the analog sensing part 16A. The analog sensing part 16A constantly monitors the vertical position of the upper end l6Ba at this lower end l6Bb and, therefore, constantly detects the vertical position of the second side 2C of the topmost sheet 2A. Specifically, the analog sensing part 16A includes a detection range 16C and detects the vertical position of the topmost sheet 2A at the second side 2C based on the position at which the top edge on the lower end 16Bb intersects the detection range 16C horizontally. The vertical position of the second side 2C on the topmost sheet 2A is equivalent to the vertical position of the first side 2B in a non-floated state. Hence, the controlling device 19 can constantly monitor the vertical position of the first side 2B for the topmost sheet 2A in a non-floated state.

The input device 21 includes a control panel (not shown) having operating buttons and a display unit. Hence, the user can manually input such information as data for the weight and quality of the sheets 2. The sheet weight can be divided into steps and inputted as ranges such as "55-90 kg."

The storing device 20 stores various data, such as data inputted via the input device 21 regarding the sheet weight and quality. Further, the storing device 20 can store reference position data indicating the optimal vertical position. The reference position data in the storing device 20 can be also overwritten.

The paper-jam-detecting device 22 can detect a paper jam such as a failure to draw a sheet to the suction device 13 (hereinafter referred to as an "failure of drawing") or a failure that multiple sheets has been fed simultaneously (hereinafter referred to as an "failure of feeding"). The paper-jam-detecting device 22 is connected to the controlling device 19. The controlling device 19 determines based on the signal transmitted from the paper-jam-detecting device 22 that the paper jam was caused by which of the failure of drawing or the failure of feeding. The paper-jam-detecting device 22 includes a photo-sensor 22*a* (not shown) and a photo-sensor 22*b* (not shown) that has a light-emitting element and a light-receiving element. The photo-sensor 22*a* detects the failure of drawing while the photo-sensor 22*b* detects the failure of feeding.

Specifically, the controlling device 19 determines that the failure of drawing has occurred when a time period from starting of driving of the driving device 17 to detecting of the sheet 2A by the photo-sensor 22*a* exceeds a predetermined period. On the other hand, the controlling device 19 determines that the failure of feeding has occurred when optical transmission amount detected by the photo-sensor 22*b* does not reach a predetermined value. Note that the photo-sensor 22*b* may detect both of the failure of drawing and feeding.

The sheet-supplying device 1 also includes an automatic size-recognizing device (not shown) that can automatically recognize the size of the paper. This automatic size-recognizing device can be employed when the sheets 2 are a standard size. If the sheet 2 is a size other than the standard sizes, the user can input the dimensions of the sheet in increments of 1 mm via the input device 21.

Figure 8:
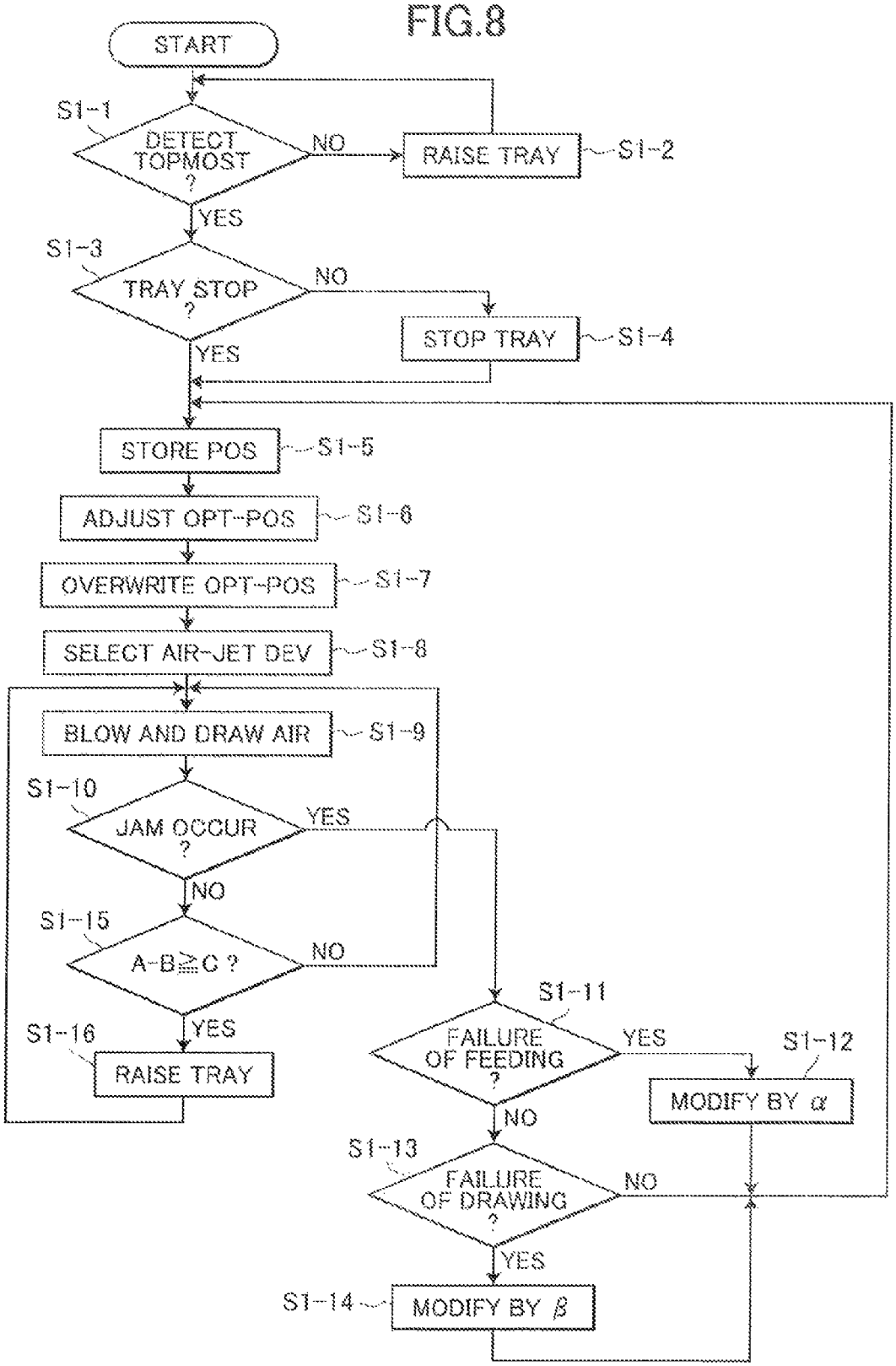
FIG. 8 is a flowchart illustrating the operations of the sheet-supplying device according to the first embodiment.

Next, steps in a control process of the controlling device 19 for controlling operations of the sheet-supplying device 1 will be described with reference to the flowchart in FIG. 8. In this embodiment, the reference position sensor 15 and the analog position sensor 16 always keep monitoring the topmost sheet 2A.

The controlling device 19 monitors whether the reference position sensor 15 has detected that the topmost sheet 2A has contacted the surface position-detecting lever 15B (S1-1). If the reference position sensor 15 has not detected this contact (S1-1: NO), the controlling device 19 raises the sheet-accommodating tray 11 (S1-2), and then the controlling device 19 monitors again whether the position sensor 16 has not detected this contact (S1-1). When the reference position sensor 15 detects that the topmost sheet 2A has contacted the surface position-detecting lever 15B (S1-1: YES), then the controlling device 19 judges whether the sheet-accommodating tray 11 has stopped (S1-3). When the sheet-accommodating tray 11 has not stopped (S1-3: NO), the controlling device 19 stops the raising of the sheet-accommodating tray 11 (S 1-4).

When the sheet-accommodating tray 11 has stopped (S1-3: YES), the controlling device 19 stores the vertical position of the second side 2C detected by the analog position sensor 16 in the storing device 20 as reference position data indicating the optimal vertical position of the second side 2C (S1-5).

By the way, information as data for quality of the sheets is not considered when the optimal vertical position is determined. Accordingly, a fine adjustment is necessary, where the optimal vertical position is lowered when the sheet 2 is thin, and the optimal vertical position is raised when the sheet 2 is thick.

Thus, the controlling device 19 performs a fine adjustment of the optimal vertical position based on information with respect to the quality of the sheets 2 that has stored in the storing device 20 (S1-6). Then the controlling device 19 restores the adjusted optimal vertical position as reference position data in the storing device 20 (S1-7).

The controlling device 19 selects at least one of the first, second and third air-jetting device 14 based on information with respect to the weight of the sheet 2 that is stored in the storing device 20 (S 1-8). For example, the controlling device 19 selects only the air-jetting device 14 at the first position when the sheet 2 is light, while selecting the air-jetting devices 14 at all the positions when the sheet 2 is heavy. Then, the controlling device 19 controls the selected air-jetting device 14 to blow air onto the one end of the sheets 2 stacked on the sheet-accommodating tray 11 and the air suction device 13 to draw air in (S1-9).

Figure 1:
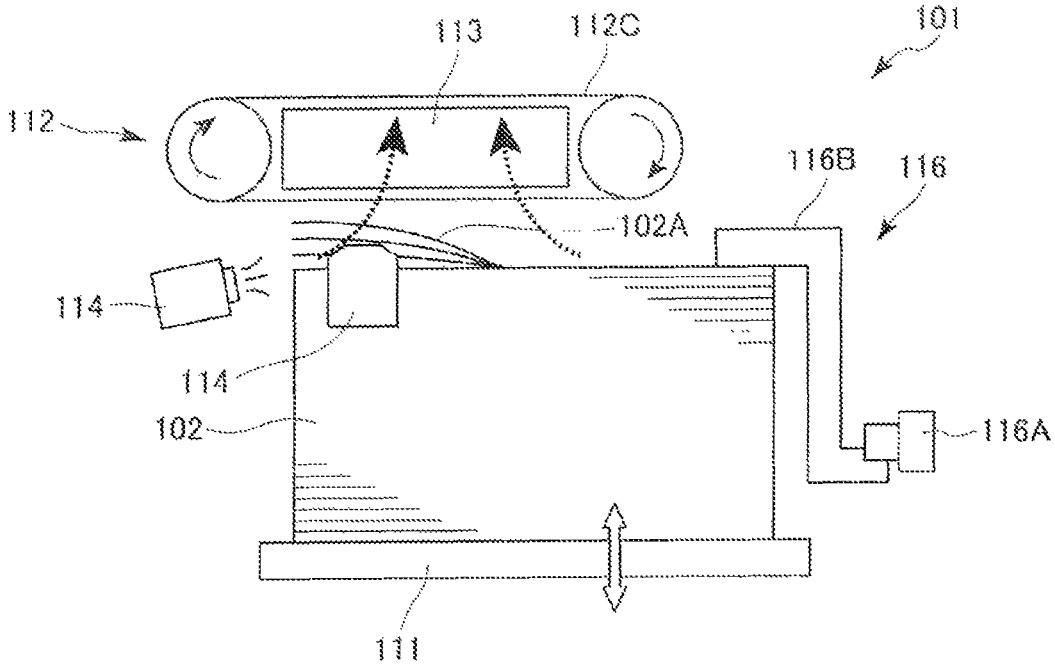
FIG. 1 is a side view of a conventional sheet-supplying device in which the topmost sheet is drawn toward a feeding belt.
Figure 2:
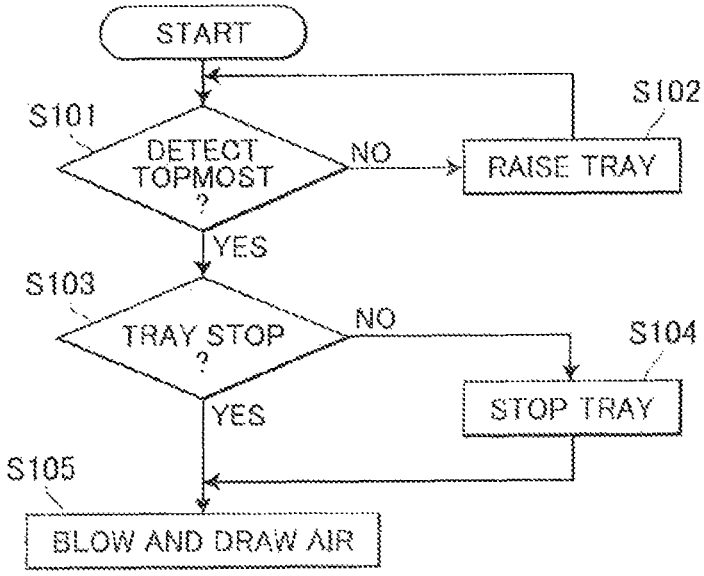
FIG. 2 is a flowchart illustrating the operations of the conventional sheet-supplying device.
Figure 3:
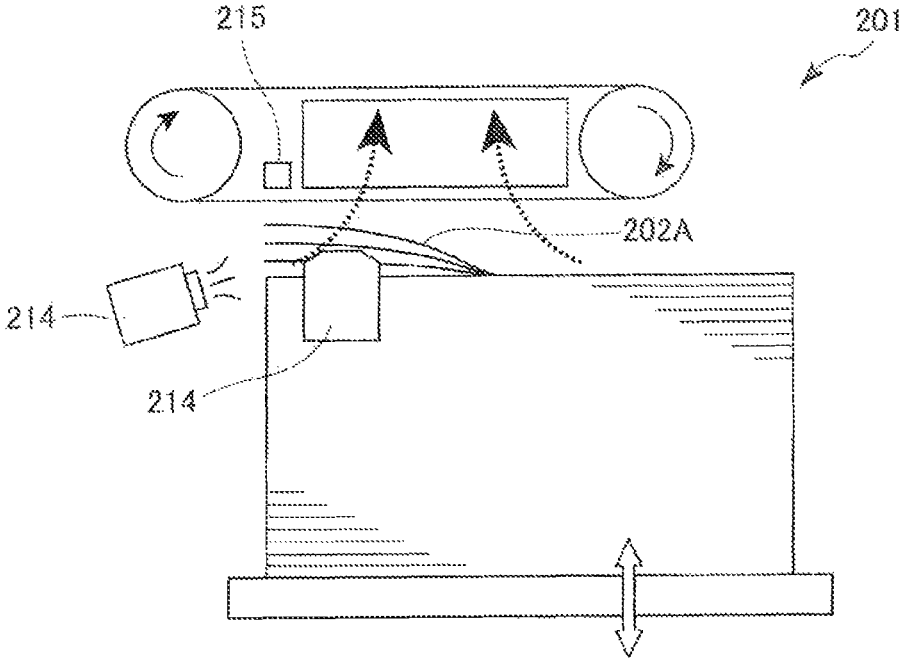
FIG. 3 is a side view showing another conventional sheet-supplying device in which the topmost sheet is drawn toward a feeding belt.
Figure 5:
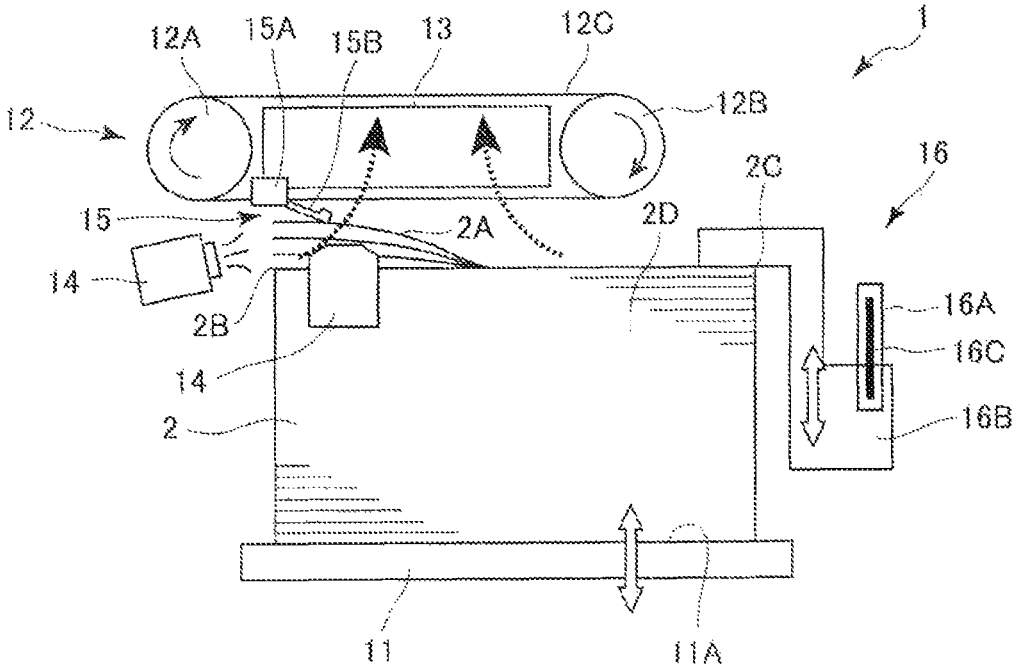
FIG. 5 is a side view showing the sheet-supplying device of the first embodiment in which the topmost sheet is drawn toward a feeding belt.

The air ejected from the air-jetting devices 14 onto the sheets 2 stacked on the sheet-accommodating tray 11 causes a few of the sheets 2 to float and separate, as shown in FIG. 5. The suction device 13 picks up the topmost sheet 2A from among the separated sheets 2 and draws the topmost sheet 2A to the sheet-feeding belt 12C. The rotating sheet-feeding belt 12C conveys the topmost sheet 2A to a prescribed position at which the paper-jam-detecting device 22 is located.

The controlling device 19 determines whether a paper jam has occurred (S1-10). If a paper jam has occurred (S1-10: YES), then the controlling device 19 determines whether the paper jam was caused by the failure of feeding (S1-11). If the controlling device 19 determines that the paper jam was caused by the failure of feeding (S1-11: YES), then the controlling device 19 modifies the reference position data stored in the storing device 20 with data for a vertical position below the reference position by a first prescribed amount a (S1-12), and returns to S1-5.

On the other hand, if the paper jam was not caused by the failure of feeding (S1-11: NO), then the controlling device 19 determines whether the paper jam was caused by a failure of drawing (S-13). If the controlling device 19 determines that the paper jam was caused by the failure of drawing (S1-13: YES), then the controlling device 19 overwrites the reference position data stored in the storing device 20 with data for a vertical position above the reference position by a second prescribed amount ? (S1-14), and returns to S1-5. If the paper jam was not caused by the failure of drawing (S1-13: NO), the controlling device 19 returns to S1-5 directly. Here, ? and ? are amounts predetermined based on the sheet weight and quality.

Described above, the analog position sensor 16 always keeps detecting the topmost sheet 2A. For the convenience of description, data for the vertical position stored in the storing device 20 at S1-5 will be represented by the value "A", and data for the vertical position detected continually by the analog position sensor 16 will be represented by the value "B". The controlling device 19 repeatedly calculates the difference between the value A and the value B, and compares this difference (A-B) to a prescribed value C. Here, the prescribed value C is a predetermined value that accounts for the sheet weight and quality.

If a paper jam has not occurred (S1-10: NO), the controlling device 19 determines whether the difference (A-B) is equal to or greater than the prescribed value C (S1-15). When the difference (A-B) is less than the prescribed value C (S1-15: NO), the controlling device 19 returns to S1-9 in order to convey another topmost sheet 2A. On the other hand, the difference (A-B) is equal to or greater than the prescribed value C (S1-15: YES), the controlling device 19 raises the sheet-accommodating tray 11 the height corresponding to the difference (A-B) (S1-16), and then returns to S1-9 in order to convey another topmost sheet 2A.

Since both of the reference position sensor 15 and the analog position sensor 16 detects the vertical position for the second side 2C of the topmost sheet 2A in the preferred embodiment, the first side 2B of the topmost sheet 2A can be maintained in the optimal vertical position, even when there is curl in the sheets 2. Further, since this process is implemented with a simple configuration including two sensors (the reference position sensor 15 and analog position sensor 16), the manufacturing costs for the sheet-supplying device 1 can be reduced.

Further, the sheet quality is considered when the topmost sheet 2A is positioned in the optimal vertical position, and the combination of the first, second and third air-jetting device 14 is selected based on the sheet weight. Hence, the sheet-supplying device 1 can reliably pick up sheets without requiring adjustments in the position, angle, and amount of air ejection.

When a paper jam is detected, the controlling device 19 determines whether the paper jam was caused by the failure of drawing or feeding, and adjusts the vertical position of the sheets according to the cause. If the paper jam was caused by the failure of feeding, the controlling device 19 adjusts the reference position vertically downward by the first prescribed amount α. By moving the vertical position of the topmost sheet 2A downward a fixed amount, the controlling device 19 can reduce the suction force of the suction device 13 on the topmost sheet 2A and prevent a plurality of sheets 2 from being picked up simultaneously. Using these adjustments, the controlling device 19 can avoid feeding multiple sheets simultaneously, even when there is curl in the sheets 2.

If the paper jam was caused by the failure of drawing, then the controlling device 19 adjusts the reference position upward by the second prescribed amount β. By moving the position of the topmost sheet 2A upward a fixed amount, the controlling device 19 can increase the suction force of the suction device 13 on the topmost sheet 2A to ensure that the topmost sheet 2A is picked up. Through this adjustment, the controlling device 19 can reliably feed sheets without skipping sheets, even when there is curl in the sheets 2.

Next, a sheet-supplying device according to a second embodiment of the present invention will be described. The sheet-supplying device according to the second embodiment can detect sheets having such a large curl that the second side 2C of the sheets 2 is outside the detection range of the analog position sensor.

As described above, the analog sensing part 16A detects the vertical position of the topmost sheet 2A at the second side 2C based on the position at which the top edge on the lower end 16Bb intersects the detection range 16C horizontally.

Figure 9:
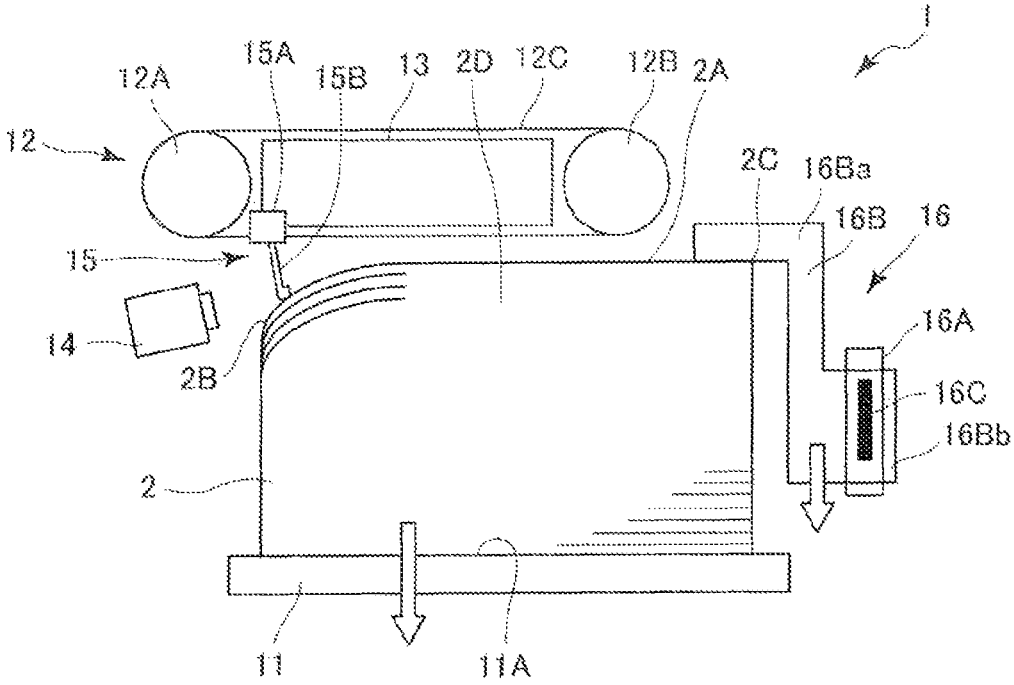
FIG. 9 is a side view of a sheet-supplying device according to a second embodiment of the present invention in which the sheets have a large downward curl (the sheets are out of a detection range for an analog position sensor)

However, if the sheet 2 has a very large downward curl, as shown in FIG. 9, the sheet-accommodating tray 11 and the surface position-detecting lever 16B that moves together with the sheet-accommodating tray 11 are raised to a much higher position than normal in order that the reference position sensor 15 can detect the first side 2B of the topmost sheet 2A that is much lower than the actual vertical position of the topmost sheet 2A.

As a result, the upper edge on the lower end 16Bb is raised to a position that does not intersect the detection range 16C horizontally. Since the analog sensing part 16A cannot detect the surface position-detecting lever 16B, it is impossible to compare the difference (A-B) with the prescribed value C.

Figure 10:
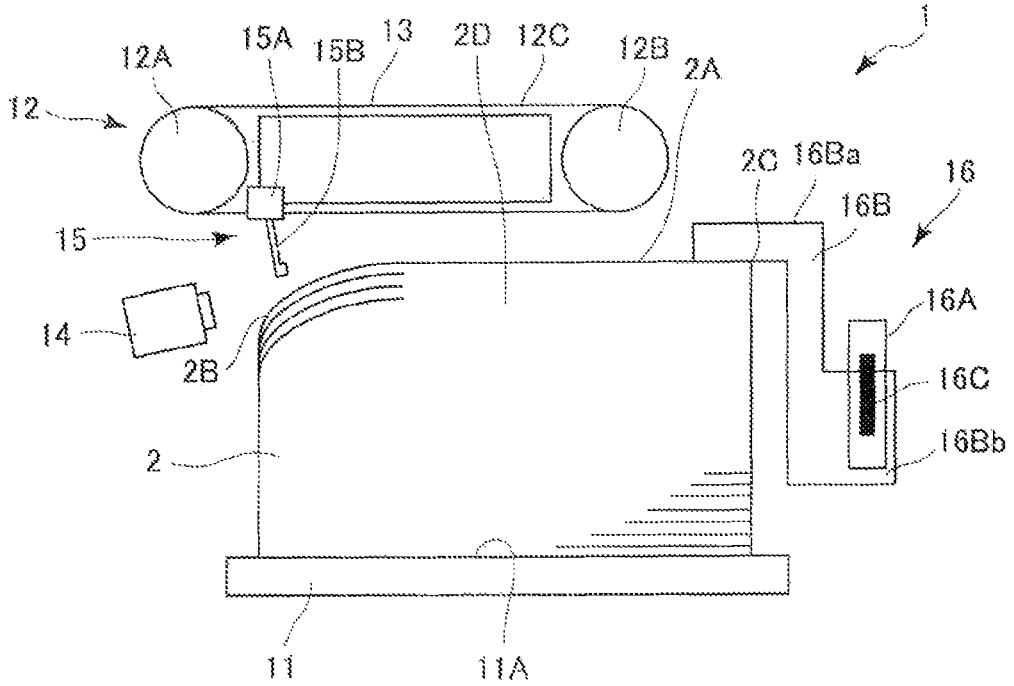
FIG. 10 is a side view illustrating the operations of the sheet-supplying device according to the second embodiment when the sheets have a large downward curl.

Therefore, when the upper edge on the lower end 16Bb is in a position that no longer intersects the detection range of the analog sensing part 16A, in the preferred embodiment, the controlling device 19 adjusts the height of the sheet-accommodating tray 11 until the upper edge on the lower end 16Bb horizontally intersects the detection range, as shown in FIG. 10.

Figure 11:
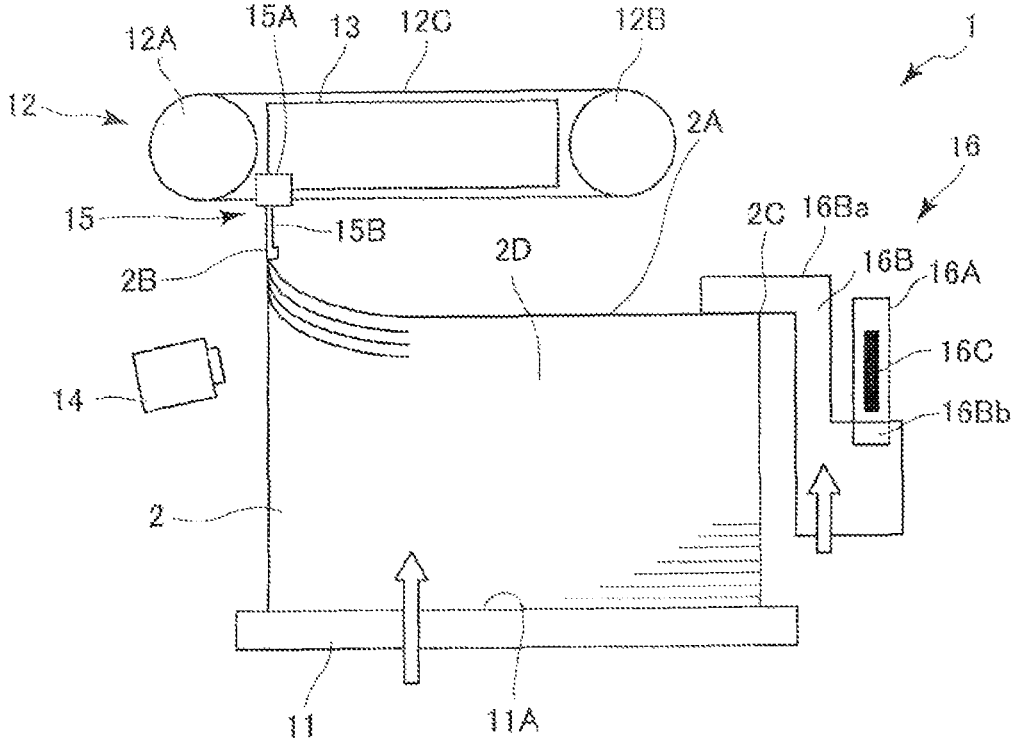
FIG. 11 is a side view showing the sheet-supplying device according to the second embodiment when the sheets have a large upward curl (when the sheets are outside of a detection range for the analog position sensor)
Figure 12:
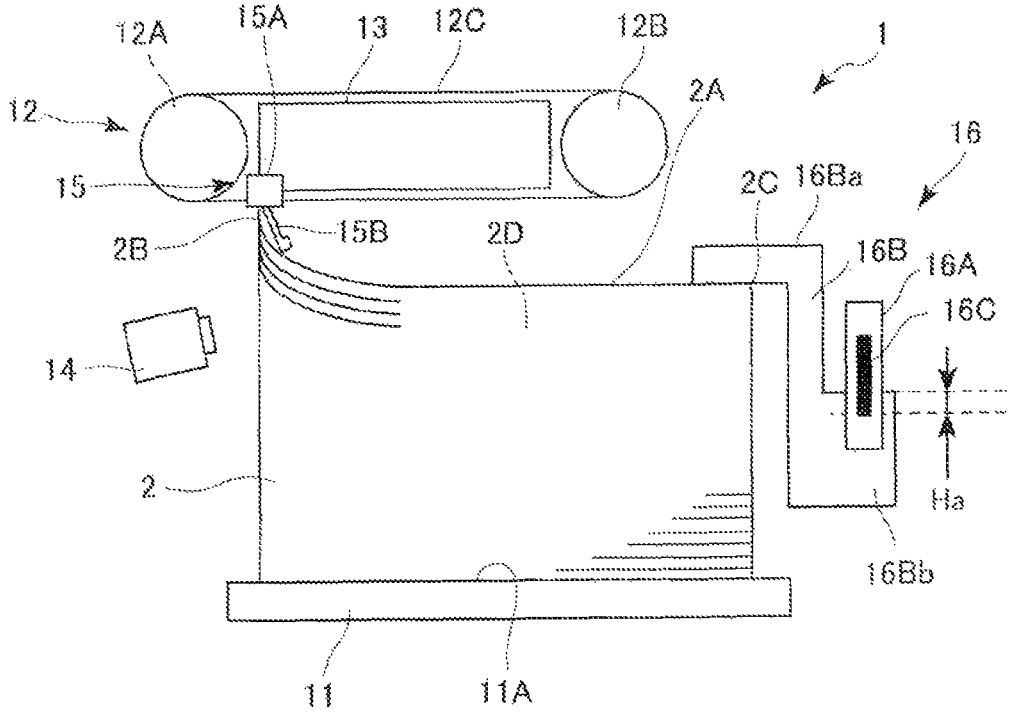
FIG. 12 is a side view illustrating the operations of the sheet-supplying device according to the second embodiment when the sheets have a large upward curl.

Further, if the sheet 2 has a considerably large upward curl, as shown in FIG. 11, the reference position sensor 15 detects the position of the topmost sheet 2A at a considerably higher position than the actual vertical position of the topmost sheet 2A. However, at this time, the sheet-accommodating tray 11 and the surface position-detecting lever 16B that moves together with the sheet-accommodating tray 11 have only been raised to a position much lower than a proper position.

Consequently, if the upper edge on the lower end 16Bb has not been raised to a position that horizontally intersects the detection range 16C, then the analog sensing part 16A cannot detect the surface position-detecting lever 16B. Accordingly, it is impossible to compare the difference (A-B) with the prescribed value C.

Therefore, when the upper edge on the lower end 16Bb has not reached the lower end of the detection range 16C, in the preferred embodiment, the controlling device 19 raises the sheet-accommodating tray 11 until the surface position-detecting lever 16B is positioned a prescribed amount Ha (mm) above the lower end of the detection range 16C. The prescribed amount Ha is a distance sufficiently above the lower end of the detection range 16C from which variations in output from the analog sensing part 16A can be detected when the number of sheets 2 on the sheet-accommodating tray 11 decreases during consecutive feeding and the surface position-detecting lever 16B drops.

Figure 13:
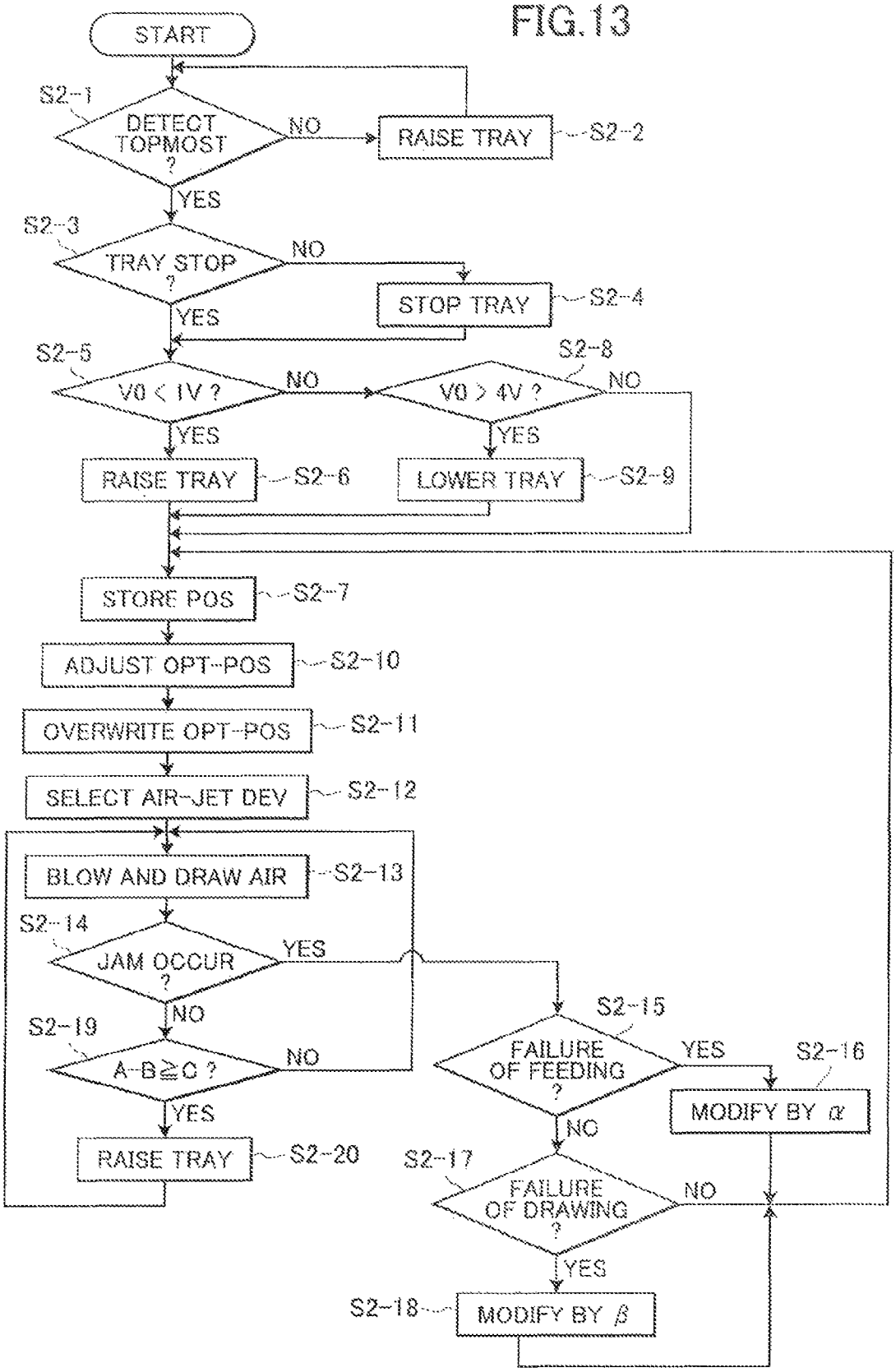
FIG. 13 is a flowchart illustrating steps in the operations of the sheet-supplying device according to the second embodiment.

Next, steps in the control process of the controlling device 19 for controlling operations of the sheet-supplying device 1 according to the second embodiment will be described with reference to the flowchart in FIG. 13. In this description, the analog position sensor 16 is a transmitting analog sensor having a voltage output of 0-5 V.

The controlling device 19 monitors whether the reference position sensor 15 has detected that the topmost sheet 2A has contacted the surface position-detecting lever 15B (S2-1). If the reference position sensor 15 has not detected this contact (S2-1: NO), the controlling device 19 raises the sheet-accommodating tray 11 (S2-2), and then the controlling device 19 monitors again whether the reference position sensor 15 has not detected this contact (S2-1). When the reference position sensor 15 detects that the topmost sheet 2A has contacted the surface position-detecting lever 15B (S2-1: YES), then the controlling device 19 judges whether the sheet-accommodating tray 11 has stopped (S2-3). When the sheet-accommodating tray 11 has not stopped (S2-3: NO), the controlling device 19 stops the raising of the sheet-accommodating tray 11 (S2-4).

The analog position sensor 16 is detecting constantly the vertical position of the second side 2C. The detection value that is detected by the analog position sensor 16 when the sheet-accommodating tray 11 stops will be referred to as $V_0$. Then, the controlling device 19 determines whether the detected output $V_0$ is less than 1 V ($V_0$<1 V) (S2-5).

If $V_0$ is less than 1 V (S2-5: YES), then the controlling device 19 determines that the analog sensing part 16A cannot detect the surface position-detecting lever 16B having a considerably large upward curl. Therefore, when $V_0$ is less than 1 V (S2-5: YES), the controlling device 19 raises the sheet-accommodating tray 11 until the output $V_0$ detected by the analog position sensor 16 is equivalent to $V_{Ha}$ ($V_0$=$V_{Ha}$) (S2-6). Here, $V_{Ha}$ is the output voltage that can be detected by the analog sensing part 16A when the top edge on the lower end 16Bb intersects the detection range 16C at a position above the lower end of the detection range 16C by the prescribed amount Ha (mm). When $V_0$ equals $V_{Ha}$, the controlling device 19 stores the vertical position detected by the analog position sensor 16 in the storing device 20 as reference position data indicating that the sheet-accommodating tray 11 is in the optimal vertical position (S2-7). The value of the reference position data stored in the storing device 20 at this time will be denoted by "A".

However, if $V_0$ is greater than 1 V (S2-5: NO), then the controlling device 19 determines whether $V_0$ is greater than 4 V (S2-8). If $V_0$ is greater than 4 V (S2-8: YES), then the controlling device 19 determines that the surface position-detecting lever 16B has completely blocked the analog sensing part 16A due to a considerably large downward curl in the sheet 2 and lowers the sheet-accommodating tray 11 until the output $V_0$ from the analog position sensor 16 reaches 4 V (S2-9). The controlling device 19 stores the vertical position detected by the analog position sensor 16 in the storing device 20 as reference position data (S2-7). However, if the $V_0$ is less than 4 V (S2-8: NO), then the controlling device 19 executes the operations in S2-7 directly.

Thereafter, the controlling device 19 executes operations from S2-10 to S2-20. Since these operations are identical to the operations from S1-6 to S1-16 in the first embodiment, a description of these operations has been omitted.

The sheet-supplying device according to embodiments described above performs sheet-feeding operations by raising and lowering the sheet-accommodating tray according to the amount of curl in the sheets when the curl is so large that the sheets are positioned outside the detection range 16C of the analog position sensor 16.

The sheet-supplying device of the present invention can be applied to electrostatic recording devices, such as electrophotographic printers and copiers, and particularly to sheet-supplying devices requiring a reduced manufacturing cost.

While the invention has been described in detail with reference to specific embodiments thereof, it would be apparent to those skilled in the art that many modifications and variations may be made therein without departing from the spirit of the invention, the scope of which is defined by the attached claims. For example, in the preferred embodiments described above, the reference position sensor 15 is configured of the digital sensor 15A, such as a photosensor equipped with an actuator or the like. However, the reference position sensor 15 may also be configured of an analog sensor.

Further, the analog position sensor 16 in the embodiments described above detects the vertical position of the lower end 16Bb of the surface position-detecting lever 16B. However, rather than using the surface position-detecting lever 16B, an analog sensor may be used to directly detect the height of the sheet-accommodating tray 11, or the vertical position of the topmost sheet 2A stacked on the sheet-accommodating tray 11.

What is claimed is:

1. A sheet-supplying device comprising:

a sheet-accommodating tray that supports a plurality of sheets stacked in a vertical direction, wherein each sheet has a first end portion having a first edge and a second end portion having a second edge;

an air jetting unit that blows air to the first edge of a topmost sheet of the plurality of sheets to float the first edge;

a sheet-conveying unit formed with a plurality of sucking holes for attracting a floated sheet, only a floated topmost sheet being attracted by the plurality of sucking holes when the first end portion is at a prescribed position in the stacking direction, the sheet-conveying unit conveying the attracted sheet;

a raising/lowering unit that raises and lowers the sheet-accommodating tray in the vertical direction;

a first position sensor that contacts the first end portion to detect a position of the first end portion of the topmost sheet in the vertical direction;

a second position sensor that contacts the second end portion including the second edge by moving in the vertical direction to detect a position of the second edge of the topmost sheet in the vertical direction; and a controlling unit controlling the raising/lowering unit to raise or lower the sheet-accommodating tray based on both the position detected by the first position sensor and the position detected by the second position sensor, wherein the controlling unit controls the raising/lowering unit to raise the sheet-accommodating tray until the first position sensor detects the first end portion before a sheet-conveying operation of the sheet-conveying unit starts, wherein the controlling unit controls the raising/lowering unit to raise the sheet-accommodating tray when determining, based on the position of the second edge detected by the second position sensor, that the plurality of sucking holes cannot attract only the topmost sheet during the sheet-conveying operation.

2. The sheet-supplying device according to claim 1, wherein the controlling unit controls the raising/lowering unit based on sheet data so that the topmost sheet is positioned at a position optimal for the plurality of sucking holes to attract only the topmost sheet.

3. The sheet-supplying device according to claim 2, wherein the sheet data indicates a weight of a sheet.

4. An image-forming device comprising the sheet- supplying device of claim 1.

5. The sheet-supplying device according to claim 1, wherein the second position sensor comprises a lever extending in a horizontal direction to contact the topmost sheet.

6. The sheet-supplying device according to claim 5, wherein the lever constantly contacts the second side of the topmost sheet.

7. The sheet-supplying device according to claim 6, wherein the second position sensor has a detection range in the vertical direction.

8. The sheet-supplying device according to claim 6, wherein the controlling unit controls the raising/lowering unit based on sheet data so that a topmost sheet is positioned at a position optimal for the plurality of sucking holes to attract only the topmost sheet.

9. The sheet-supplying device according to claim 8, wherein the sheet data indicates a weight of the sheet.

10. An image-forming device comprising the sheet supplying device according to claim 9.

11. The sheet-supplying device according to claim 1, wherein the second position sensor contacts the second side with an own weight.

12. An image-forming device comprising:

a sheet-accommodating tray that supports a plurality of sheets stacked in a vertical direction, wherein the sheet has a first end portion having a first edge and a second end portion having a second edge;

an air jetting unit that blows air to the first edge of a topmost sheet of the plurality of sheets to float the first edge;

a sheet-conveying unit formed with a plurality of sucking holes for attracting the floated sheet, only the floated topmost sheet being attracted by the plurality of sucking holes when the first end portion is at a prescribed position in the stacking direction, the sheet-conveying unit conveying the attracted sheet;

a raising/lowering unit that raises and lowers the sheet-accommodating tray in the vertical direction;

a first position sensor that contacts the first end portion to detect a position of the first end portion of the topmost sheet in the vertical direction;

a second position sensor that contacts the second end portion including the second edge by moving in the vertical direction to detect a position of the second edge of the topmost sheet in the vertical direction; and a controlling unit controlling the raising/lowering unit to raise or lower the sheet-accommodating tray based on both the position detected by the first position sensor and the position detected by the second position sensor, wherein the controlling unit controls the raising/lowering unit to raise the sheet accommodating tray until the first position sensor detects the first end portion before a sheet-conveying operation of the sheet-conveying unit starts, wherein the controlling unit controls the raising/lowering unit to raise the sheet-accommodating tray when determining, based on the position of the second edge detected by the second position sensor, that the plurality of sucking holes cannot attract only the topmost sheet during the sheet-conveying operation.

13. A sheet-supplying device comprising:

a sheet-accommodating tray that supports a plurality of sheets stacked in a vertical direction, wherein each sheet has a first end portion having a first edge and a second end portion having a second edge;

an air jetting unit that blows air to the first edge of a topmost sheet of the plurality of sheets to float the first edge;

a sheet-conveying unit formed with a plurality of sucking holes for attracting a floated sheet, only a floated topmost sheet being attracted by the plurality of sucking holes when the first end portion is at a prescribed position in the stacking direction, the sheet-conveying unit conveying the attracted sheet;

a raising/lowering unit that raises and lowers the sheet-accommodating tray in the vertical direction;

a first position sensor that contacts the first end portion to detect a position of the first end portion of the topmost sheet in the vertical direction;

a second position sensor that contacts the second end portion including the second edge by moving in the vertical direction to detect a position of the second edge of the topmost sheet in the vertical direction; and a controlling unit controlling the raising/lowering unit to raise or lower the sheet-accommodating tray based on both the position detected by the first position sensor and the position detected by the second position sensor, wherein the controlling unit controls the raising/lowering unit to raise the sheet-accommodating tray until the first position sensor detects the first end portion before a sheet-conveying operation of the sheet-conveying unit starts, wherein the controlling unit controls the raising/lowering unit to raise the sheet-accommodating tray based on the position of the second edge detected by the second position sensor, after the controlling unit controls the raising/lowering unit to rais the sheet-accommodating tray until the first position sensor detects the first end portion.

14. An image-forming device comprising:

a sheet-accommodating tray that supports a plurality of sheets stacked in a vertical direction, wherein the sheet has a first end portion having a first edge and a second end portion having a second edge;

an air jetting unit that blows air to the first edge of a topmost sheet of the plurality of sheets to float the first edge;

a sheet-conveying unit formed with a plurality of sucking holes for attracting the floated sheet, only the floated topmost sheet being attracted by the plurality of sucking holes when the first end portion is at a prescribed position in the stacking direction, the sheet-conveying unit conveying the attracted sheet;

a raising/lowering unit that raises and lowers the sheet-accommodating tray in the vertical direction;

a first position sensor that contacts the first end portion to detect a position of the first end portion of the topmost sheet in the vertical direction;

a second position sensor that contacts the second end portion including the second edge by moving in the vertical direction to detect a position of the second edge of the topmost sheet in the vertical direction; and a controlling unit controlling the raising/lowering unit to raise or lower the sheet-accommodating tray based on both the position detected by the first position sensor and the position detected by the second position sensor, wherein the controlling unit controls the raising/lowering unit to raise the sheet accommodating tray until the first position sensor detects the first end portion before a sheet-conveying operation of the sheet-conveying unit starts, wherein the controlling unit controls the raising/lowering unit to raise the sheet-accommodating tray based on the position of the second edge detected by the second position sensor, after the controlling unit controls the raising/lowering unit to raise the sheet accommodating tray until the first position sensor detects the first end portion.

* * * * *